US009962954B2

(12) United States Patent
Tatsuta et al.

(10) Patent No.: US 9,962,954 B2
(45) Date of Patent: May 8, 2018

(54) THERMAL PRINTER, CONTROL METHOD, AND COMPUTER PROGRAM

(71) Applicants: KABUSHIKI KAISHA TOSHIBA, Tokyo (JP); TOSHIBA TEC KABUSHIKI KAISHA, Tokyo (JP)

(72) Inventors: Shinichi Tatsuta, Taito Tokyo (JP); Junya Tanaka, Ota Tokyo (JP); Misato Ishikawa, Kawasaki Kanagawa (JP); Shunsuke Hattori, Kawasaki Kanagawa (JP); Takahiro Omori, Kawasaki Kanagawa (JP); Tetsuya Kugimiya, Kawasaki Kanagawa (JP); Kazuaki Sugimoto, Numazu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/586,656

(22) Filed: May 4, 2017

(65) Prior Publication Data

US 2017/0232759 A1 Aug. 17, 2017

Related U.S. Application Data

(63) Continuation of application No. 14/925,877, filed on Oct. 28, 2015, now Pat. No. 9,669,636.

(30) Foreign Application Priority Data

Jul. 31, 2015 (JP) ..... 2015-152763

(51) Int. Cl.
*B41J 2/355* (2006.01)

(52) U.S. Cl.
CPC ..... *B41J 2/355* (2013.01)

(58) Field of Classification Search
CPC ..... B41J 2/3555; B41J 2/3556; B41J 2/3558; B41J 2/365; B41J 2/38
See application file for complete search history.

(56) References Cited

U.S. PATENT DOCUMENTS 3,777,116 A 12/1973 Brescia et al.
4,391,535 A 7/1983 Palmer
(Continued)

FOREIGN PATENT DOCUMENTS

CN 1117437 2/1996
CN 1118746 3/1996
(Continued)

OTHER PUBLICATIONS

Japanese Office Action dated Jun. 28, 2016, filed in Japanese counterpart Patent Application No. 2015-152763 (with English Translation).

(Continued)

*Primary Examiner* — Julian Huffman
(74) *Attorney, Agent, or Firm* — Patterson & Sheridan, LLP

(57) ABSTRACT

A thermal printer includes: a plurality of heat elements that are to be heated by applying an electrical power; a printing controller that applies a first electrical power to heat elements not to be used for printing, the first electrical power depending on the number of heat elements not to be used for printing among the plurality of heat elements; and a thermal head that prints using the plurality of heat elements.

2 Claims, 8 Drawing Sheets

(56) References Cited

U.S. PATENT DOCUMENTS

| | | | |
|---|---|---|---|
| 5,629,730 | A | 5/1997 | Park |
| 6,116,714 | A | 9/2000 | Imanaka et al. |
| 7,310,106 | B2 | 12/2007 | Cui |
| 8,384,750 | B2 | 2/2013 | Matsutani |
| 2011/0242256 | A1 | 10/2011 | Matsutani |
| 2014/0098155 | A1 | 4/2014 | Martin et al. |

FOREIGN PATENT DOCUMENTS

| | | | | | |
|---|---|---|---|---|---|
| CN | 102233742 | | | 11/2011 | |
| JP | S52-138939 | A | | 11/1977 | |
| JP | S56-167480 | A | | 12/1981 | |
| JP | S56169075 | | | 12/1981 | |
| JP | 59164160 | A | * | 9/1984 | ..... B41J 2/38 |
| JP | S61-114865 | A | | 6/1986 | |
| JP | S62-100072 | | | 5/1987 | |
| JP | S63-134259 | | | 6/1988 | |
| JP | S64-61272 | | | 3/1989 | |
| JP | H07-081108 | | | 3/1995 | |
| JP | H07-237314 | | | 9/1995 | |
| JP | H09-254426 | | | 9/1997 | |
| JP | H09-314886 | | | 12/1997 | |
| JP | H10-181069 | | | 7/1998 | |
| JP | 2000-280510 | A | | 10/2000 | |
| JP | 2006-116952 | | | 5/2006 | |
| JP | 2010-089378 | | | 4/2010 | |
| WO | 2012/132988 | | | 10/2012 | |

OTHER PUBLICATIONS

Chinese Office Action dated Aug. 31, 2017, filed in Chinese counterpart Patent Application No. 201510708723.1, 14 pages (with English translation).

Japanese Notice of Allowance dated Dec. 5, 2017, filed in counterpart Japanese Patent Application No. 2017-018977, 6 pages (with translation).

* cited by examiner

FIG. 5

| TEMPERATURE OF THERMAL HEAD | SURROUNDING TEMPERATURE | S-POWER VALUE | |
|---|---|---|---|
| ... | ... | ... | 50 |
| ⋮ | ⋮ | ⋮ | 50 |

FIG. 6

| SURROUNDING TEMPERATURE | S-POWER VALUE | S-TEMPERATURE | S-STAND-BY POWER VALUE | |
|---|---|---|---|---|
| ... | ... | ... | ... | 60 |
| ⋮ | ⋮ | ⋮ | ⋮ | 60 |

FIG. 9

| | METHOD OF RELATED ART | | | METHOD OF THE PRESENT EMBODIMENT | | |
|---|---|---|---|---|---|---|
| NUMBER OF HEAT ELEMENT(S) TO BE USED FOR PRINTING | POWER VALUE OF HEAT ELEMENT(S) TO BE USED FOR PRINTING | POWER VALUE OF HEAT ELEMENT(S) NOT TO BE USED FOR PRINTING | TOTAL POWER VALUE | POWER VALUE OF HEAT ELEMENT(S) TO BE USED FOR PRINTING | POWER VALUE OF HEAT ELEMENT(S) NOT TO BE USED FOR PRINTING | TOTAL POWER VALUE |
| 0 | 10 | 0 | 0 (=10×0) | 10 | 5 | 500 (=10×0+5×100) |
| 10 | 10 | 0 | 100 (=10×10) | 10 | 4.44 | 500 (=10×10+4.44×90) |
| 20 | 10 | 0 | 200 (=10×20) | 10 | 3.75 | 500 (=10×20+3.75×80) |
| 30 | 10 | 0 | 300 (=10×30) | 10 | 2.86 | 500 (=10×30+2.86×70) |
| 40 | 10 | 0 | 400 (=10×40) | 10 | 1.67 | 500 (=10×40+1.67×60) |
| 50 | 10 | 0 | 500 (=10×50) | 10 | 0 | 500 (=10×50+0×50) |

THERMAL PRINTER, CONTROL METHOD, AND COMPUTER PROGRAM

CROSS-REFERENCE TO RELATED APPLICATION

This application is a continuation of U.S. patent application Ser. No. 14/925,877, filed on Oct. 28, 2015, which is based upon and claims the benefit of priority from Japanese Patent Application No. 2015-152763, filed on Jul. 31, 2015; the entire contents of each of which are incorporated herein by reference.

FIELD

Embodiments described herein relate generally to a thermal printer, a control method, and a computer program.

BACKGROUND

In thermal printers of related art, a voltage has been applied to a plurality of heat elements incorporated within a thermal head to heat the heat elements and to use the heat of the heat elements to print. Such a printing method has been known as thermal transfer printing or thermosensitive printing. In such printing methods related art, various measures have been taken so that the electrical power applied to the heat elements has been adjusted in accordance with changes of the surrounding temperature, the printed pattern, and the printing speed and the like to maintain a certain level of printing quality as much as possible, regardless of the conditions of use.

Depending upon the conditions of use, transient instabilities in the printing, in particular at the start of printing may occur. For this reason, poor printing (for example, faint spots) that continues until stable printing is possible led to a loss of printing quality.

The thermal printers of related art are disclosed in Japanese Patent Application Publication No. H7-81108, Japanese Patent Application Publication No. H9-314886, Japanese Patent Application Publication No. H10-181069, and Japanese Patent Application Publication No. 2006-116952.

BRIEF DESCRIPTION OF THE DRAWINGS

FIG. 5 is a drawing showing a specific example of an S-power value information table.

FIG. 6 is a drawing showing a specific example of an S-temperature S-stand-by power value information table.

FIG. 9 is a drawing showing the result of comparing a method of related art with the method of present embodiment.

DETAILED DESCRIPTION

Figure 1:
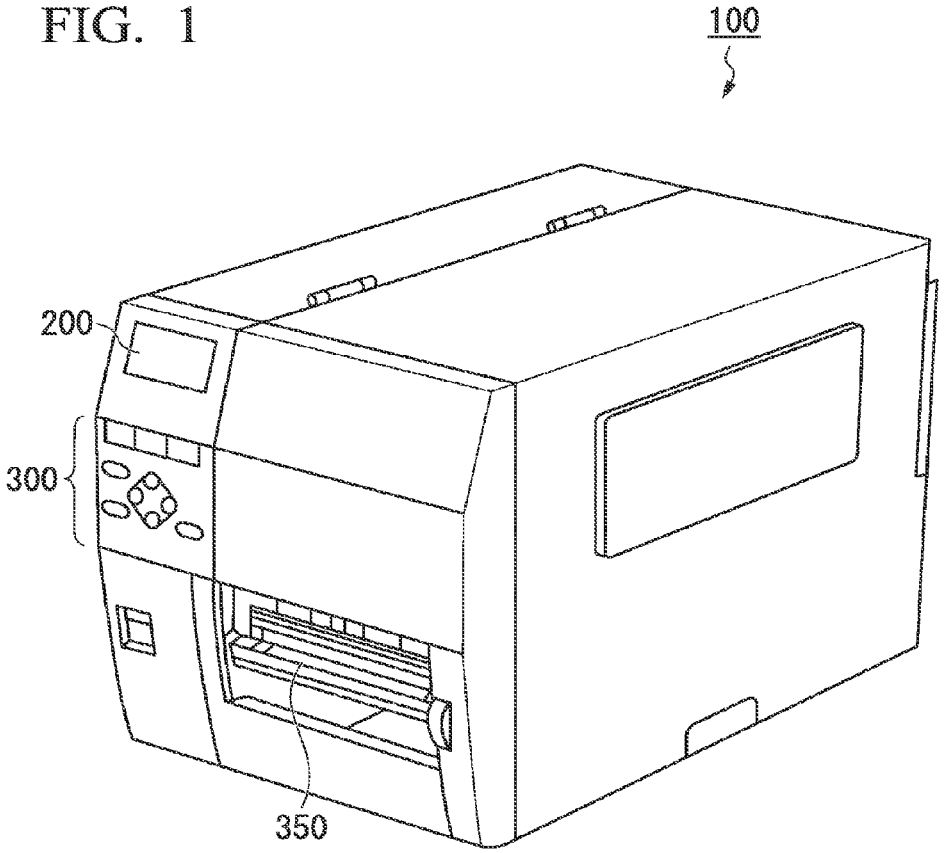
FIG. 1 is an outer view of the configuration of a thermal printer of an embodiment.

According to one embodiment, a thermal printer may include, but is not limited to: a plurality of heat elements that are to be heated by applying an electrical power; a printing controller that applies a first electrical power to heat elements not to be used for printing, the first electrical power depending on the number of heat elements not to be used for printing among the plurality of heat elements; and a thermal head that prints using the plurality of heat elements.

In some embodiments, the printing controller applies a second electrical power that is higher than the first electrical power to heat elements to be used for printing among the plurality of heat elements.

In some embodiments, the printing controller determines the first electrical power, based on the difference between the total electrical power indicating a total of electrical power applied to the plurality of heat elements and a second total electrical power indicating a total of the second electrical power, and based on the number of heat elements not to be used for printing.

In some embodiments, the printing controller determines the first electrical power by apportioning by the number of heat elements not to be used for printing.

In some embodiments, the total electrical power is fixed and independent from the number of the heat elements not to be used for printing.

In some embodiments, the total electrical power is the same as the second total electrical power in a case that the number of the heat elements to be used for the printing is largest.

In some embodiments, the printing controller, in a period during which printing is not done, applies a third electrical power to each of a part or all of the plurality of heat elements.

In some embodiments, the thermal printer may further include, but is not limited to: at least one of: a first sensor that measures a head temperature of a thermal head; a second sensor that measures a surrounding temperature; and a setter that sets a temperature value of the surrounding temperature. The printing controller applies to each of the heat elements an electrical power that is corrected by the measured or set temperature during printing or in a time period that printing is not done and the transport of the medium is stopped.

According to another embodiment, a controlling method may include, but is not limited to: applying a first electrical power to heat elements not to be used for printing, the first electrical power depending on the number of the heat elements not to be used for printing among a plurality of heat elements that are to be heated by applying an electrical power; and printing using the plurality of heat elements.

According to another embodiment, a non-transitory computer readable medium stores a computer program to be executed by a computer to cause the computer to perform: determining a first electrical power that is to be applied to heat elements which are not to be used for printing, depending on the number of the heat elements that are not to be used for printing among a plurality of heat elements that are to be heated by applying an electrical power.

A thermal printer, a control method, and a computer program of an embodiment will be described below, with references made to the drawings.

FIG. 1 is an outer view of the configuration of a thermal printer of an embodiment.

The thermal printer 100 prints a prescribed image onto a sheet and issues the sheet on which the image is printed. An example of the sheet is a label roll paper.

The thermal printer 100, as shown in FIG. 1, may include, but is not limited to, a display 200, an operating panel 300, and an ejection port 350.

The display 200 may be, but is not limited to, an image display device, such as a liquid crystal display or an organic EL (electroluminescence) display. The display 200 operates as an output interface to display characters and images. The display 200 may also operate as an input interface to accept instructions input by a user.

The operating panel 300 is configured by using input devices such as buttons. The operating panel 300 is operated by a user for inputting instructions to the thermal printer 100. For example, the operating panel 300 accepts input of the instructions to have the thermal printer 100 start printing.

The ejection port 350 ejects a sheet on which an image is printed.

Figure 2:
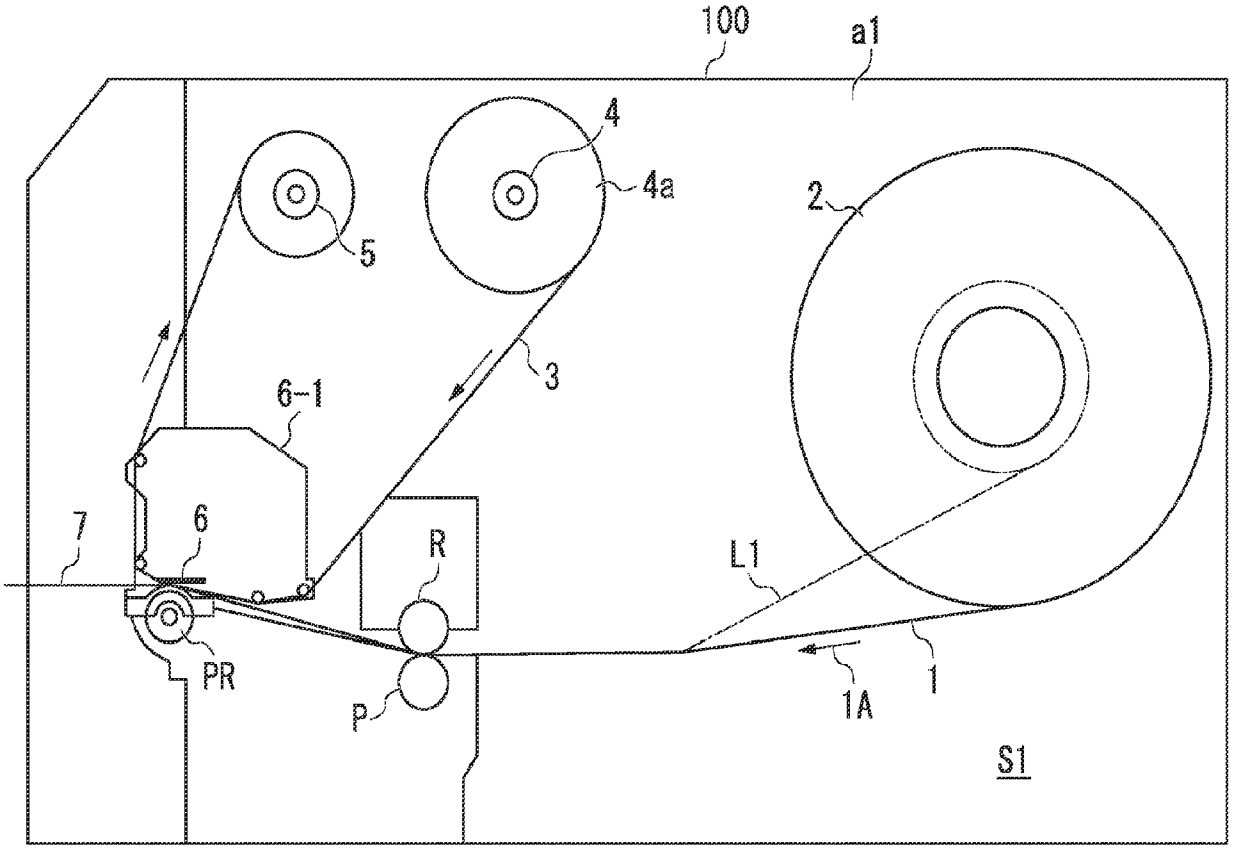
FIG. 2 is a side view showing an example of the internal configuration of the thermal printer of the embodiment.
Figure 3:
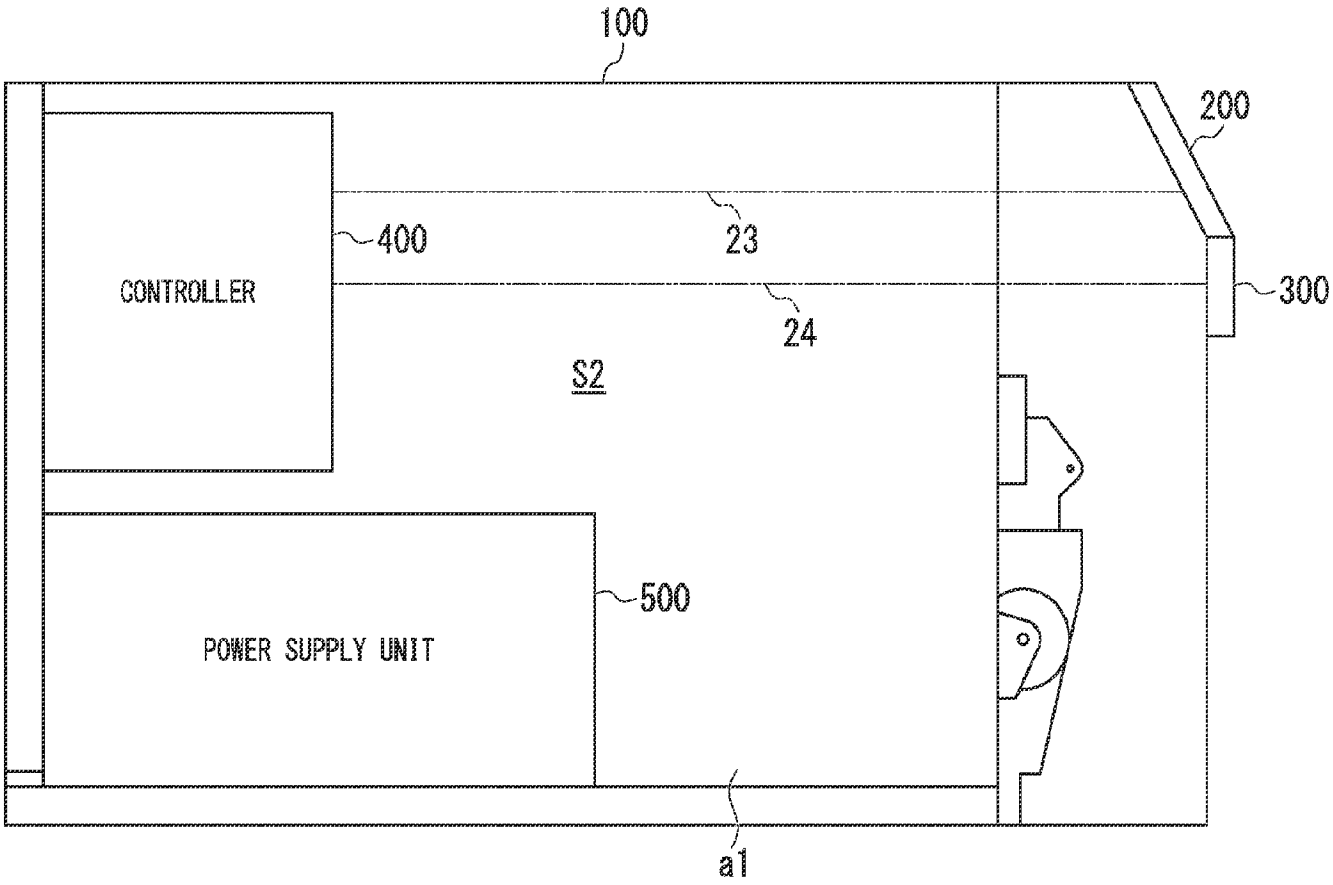
FIG. 3 is a side view showing an example of the internal configuration of the thermal printer of the embodiment.

FIG. 2 and FIG. 3 are side views showing examples of the internal configuration of the thermal printer 100 of the embodiment, shown from different sides. The thermal printer 100, as shown in FIG. 2 and FIG. 3, includes a first compartment S1 and a second compartment S2 within an enclosure of the thermal printer 100. The first compartment S1 and the second compartment S2 are separated by a vertical wall. First, using FIG. 2, the internal configuration of the first compartment S1 will be described.

The inside of the first compartment S1 may include, but is not limited to, a sheet 1, an ink ribbon 3, a supply shaft 4 of the ink ribbon 3, a take-up shaft 5 of the ink ribbon 3, a thermal head 6, a pinch roller P, a transport roller R, and a platen roller PR.

The sheet 1 may be a strip of paper. The sheet 1, by being rolled, forms the roll 2. The sheet 1, by being pulled out from the roll 2, is transported along the transport path 7.

In FIG. 2, the solid line shows the sheet 1 in the condition when the diameter of the roll 2 is relatively large. In contrast, the single-dot-dashed line L1 shows the sheet 1 in the condition when the diameter of the roll 2 is relatively small. The arrow 1A in FIG. 2 shows the direction of feed-out of the sheet 1.

The ink ribbon 3 is a tape-type ink cartridge. The ink ribbon 3 together with the sheet 1 is held between the thermal head 6 and the platen roller PR. The ink of the ink ribbon 3 is transferred to the sheet 1 by the heat from the thermal head 6.

The supply shaft 4 of the ink ribbon 3 feeds out the ink ribbon 3. The supply shaft 4 is provided on the feed-out side of the ink ribbon 3. The roll 4*a* of the ink ribbon 3 is mounted onto the supply shaft 4. In the following, the roll 4*a* of the ink ribbon 3 will be noted as the ribbon roll. The supply shaft 4 is rotationally driven by a rotary drive mechanism that includes a DC motor, gears, and belts and the like.

The take-up shaft 5 of the ink ribbon 3 takes up the ink ribbon 3. The take-up shaft 5 is provided on the take-up side of the ink ribbon 3. The take-up shaft 5 is rotationally driven by a rotary drive mechanism that includes a DC motor, gears, and belts and the like. By rotating the take-up shaft 5, the ink ribbon 3 is taken up onto the take-up shaft 5, and pulled out from the ribbon roll.

The pinch roller P is disposed in contact with the transport roller R.

The transport roller R is driven by a motor (not shown) and transports the sheet 1.

The platen roller PR is rotationally driven by a rotary drive mechanism (not shown) that includes a motor such as a stepping motor (not shown), gears, and belts and the like. The platen roller PR is disposed in opposition to the thermal head 6 provided in the printing head 6-1.

The printing head 6-1 prints an image onto a sheet. The thermal head 6 is provided to be adjacent to the printing head 6-1. The printing head 6-1 may have an surrounding temperature measurement sensor.

The thermal head 6 is disposed above and in opposition to the platen roller PR, and prints onto the transported sheet using either the ink ribbon 3 or thermosensitive paper. If a thermosensitive paper is used instead of the ink ribbon 3, the thermal printer 100 does not need to have the ink ribbon 3. In the following descriptions, the case of printing by the thermal head 6, using the ink ribbon 3 will be described as an example. The thermal head 6 presses the sheet that is transported between the platen roller PR and the thermal head against the platen roller PR and has a plurality of heat elements arranged in one row. The heat elements are heated by applying electrical power. The thermal head 6 selectively applies electrical power to a plurality of heat elements to heat them, thereby dissolving or sublimating ink of the ink ribbon 3 to transfer and print the ink onto the sheet. The thermal head 6 may have a temperature sensor such as a thermistor. The temperature sensor is disposed close to the heat elements in the center of the head to measure the temperature of the thermal head 6. The temperature of the thermal head 6 will be referred to below as the temperature of thermal head.

The mechanism configured by the thermal head 6, the ink ribbon 3, the supply shaft 4, the take-up shaft 5, the rotary drive mechanism and the platen roller PR will be noted below as a printing mechanism (printing unit). Also, in the following description, among a plurality of heat elements the heat elements to be used for printing will be described as heat elements to be used for printing and the heat elements not to be used for printing will be described as heat elements not to be used for printing. Among the plurality of heat elements of the thermal head 6, for example, the remaining heat elements other than the heat elements to be used for printing are heat elements not to be used for printing. In the following description, unless particularly noted between heat elements to be used for printing and heat elements not to be used for printing, these will be simply referred as heat elements.

A surrounding temperature measuring sensor measures the temperature within the thermal printer 100 at a position in the vicinity of the thermal head 6 as long as the surrounding temperature measuring sensor is not influenced by the temperature of thermal head. The temperature within the thermal printer 100 will be mentioned below as a surrounding temperature.

The configuration within the second compartment S2 will be described using FIG. 3.

As shown in FIG. 3, the second compartment S2 includes the controller 400 and a power supply unit 500.

The controller 400 controls the overall operations of the thermal printer 100. The controller 400, for example, controls the motor of the transport roller R, thereby controlling the transporting of the sheet 1. The controller 400 controls the printing mechanism to print data to be printed to the sheet 1 (hereinafter, referred to as "printing data"). The controller 400 determines an electrical power to be applied to heat elements not to be used for printing based on the printing data. The controller 400 applies the determined electrical power to the heat elements not to be used for printing. In this case, the electrical power to be applied to the heat elements not to be used for printing corresponds to a first electrical power, and the total electrical power thereof corresponding to a first total electrical power. The controller 400 determines an electrical power to be applied heat elements to be used for printing based on the printing data. The controller 400 applies the determined electrical power to the heat elements to be used for printing. In this case, the electrical power to be applied to the heat elements to be used for printing corresponds to a second electrical power, and the total electrical power thereof corresponding to a second total electrical power.

The power supply unit 500 supplies power to the thermal printer 100. The broken line 23 represents the path in which data passes through between the display 200 and the controller 400 that are provided in the thermal printer 100. The broken line 24 represents the path in which data passes through between the controller 400 and the operating panel 300.

Figure 4:
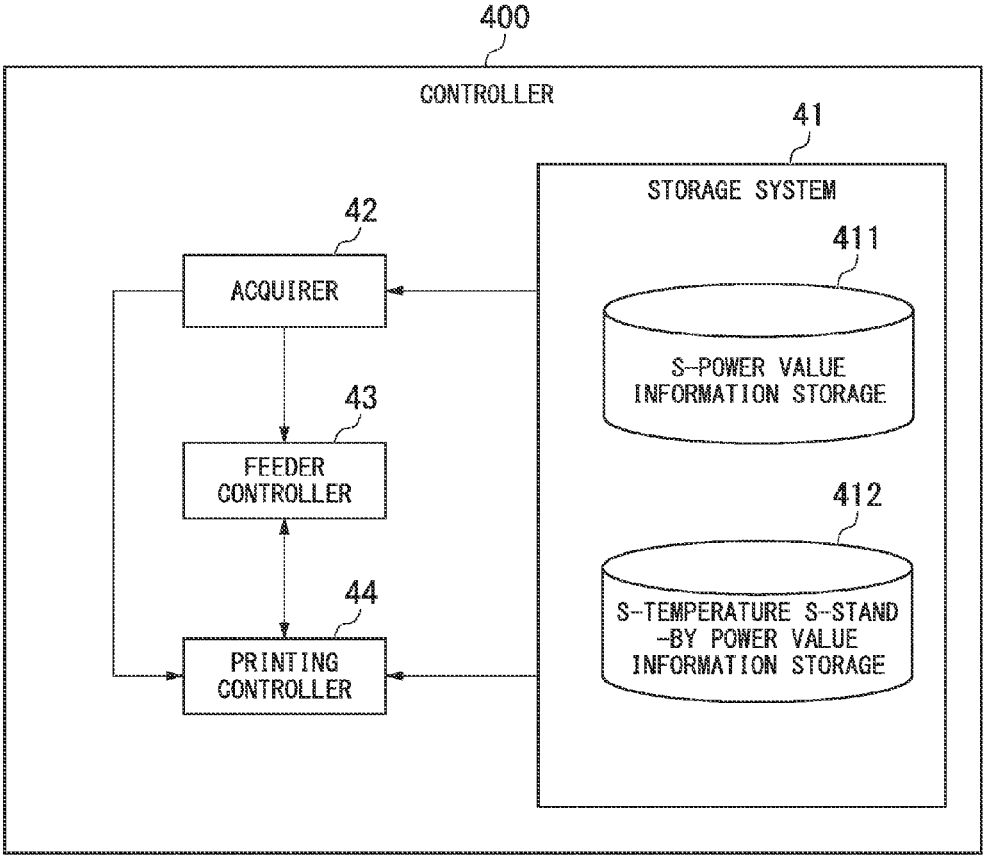
FIG. 4 is a simplified block diagram showing the functional configuration of a controller.

FIG. 4 is a simplified block diagram showing the functional configuration of a controller 400.

The controller 400 has a CPU (central processing unit), a memory, an auxiliary storage device and connected by a bus for executing a control program. By executing the control program, the controller 400 functions as a device having a storage system 41, an acquirer 42, a feeder controller 43, and a printing controller 44. All or a part of the functions of the controller 400 may be implemented using hardware such as an ASIC (application-specific integrated circuit), a PLD (programmable logic device), or an FPGA (field-programmable gate array). Also, the control program may be recorded into a computer-readable storage medium. The term "computer-readable storage medium" refers to a removable medium, such as a flexible disk, an optomagnetic disk, a ROM, a CD-ROM, or the like, and a storage device such as a hard disk built into a computer system. Additionally, the control program may be transmitted and received via an electrical communication circuit.

The storage system 41 stores various information and is configured by an S-power value information storage 411 and an S-temperature S-stand-by power value information storage 412.

The S-power value information storage 411 is configured using a storage device, such as a magnetic hard disk device or a semiconductor storage device and stores an S-power value information table, which is configured by records indicating information regarding the S-power value (hereinafter, referred to as "S-power value information records"). The S-power value represents a total electrical power applied to heat elements to be used for printing in the case of the largest number thereof, among the heat elements to be used for printing at each timing of printing in the printing pattern assumed at the time of printing (second total electrical power in the case of the largest number of the heat elements to be used for printing). In the following, the heat elements in the case of the largest number of heat elements used for printing among the heat elements to be used for printing at each timing of printing will be referred to collectively as the maximum heat elements to be used for printing. The printing pattern assumed for printing is, for example, a printing format.

FIG. 5 is a drawing showing a specific example of an S-power value information table.

The S-power value information table has a plurality of S-power value information records 50, each of which has a value of a temperature of thermal head, a surrounding temperature, and an S-power value. The value of the temperature of thermal head indicates the temperature of a thermal head 6. The value of the surrounding temperature indicates the temperature inside the thermal printer 100. The S-power value indicates a total value of the electrical power applied to the maximum number of heat elements to be used for printing under the environment of the temperature of thermal head and the surrounding temperature of that S-power value information record 50. The S-power values for each of the temperature of thermal heads and surrounding temperatures are recorded for a given time interval into the S-power value information table. The given time interval may be, for example, one time each, once each five times, or some other time interval. Alternatively, only the two values, of the surrounding temperature and the S-power value, may be recorded into the S-power value information table. In the power value information table, the approximate maximum value of the printing density in normal usage is determined experimentally or statistically, and then the S-power values are recorded, in which the total electrical power values of the case are calculated based on conditions such as a paper feeding speed, the paper type, the ink ribbon type, and thermal head characteristics, the temperature of thermal head, the surrounding temperature or historical compensation. Also, it is not necessary that data of all combinations of the temperature of thermal head, the surrounding temperature, and the S-power value are recorded into the S-power value information table, and, for example, data of a part of the combinations may be recorded therein. In this case, all combinations are the combinations at the above-noted given interval. If the data of a part of the combinations is recorded into the S-power value information table, necessary data may be calculated by using a correction coefficient or interpolation.

Referring back to FIG. 4, the descriptions of the controller 400 will be continued.

The S-temperature S-stand-by power value information storage 412 is configured using a storage device, such as a magnetic hard disk device or a semiconductor storage device and stores an S-temperature S-stand-by power value information table, which is configured by records indicating information regarding the S-temperature and the S-stand-by power value (hereinafter, refer to as "S-temperature S-stand-by power value information records"). The S-temperature represents an assumed temperature reached by the thermal head 6 in a case that power at the S-power value is continuously applied for printing during the feeding of the sheet 1. The S-stand-by power value represents the power value necessary for raising the temperature of thermal head to S degrees by applying the same electrical power to all heat elements under the condition that the sheet 1 is not be transported.

FIG. 6 is a drawing showing a specific example of an S-temperature S-stand-by power value information table.

The S-temperature S-stand-by power value information table has a plurality of S-temperature S-stand-by power value information records 60, each of which has a value of the surrounding temperature, the S-power value, and the S-temperature S-stand-by power value. The value of the surrounding temperature indicates the temperature inside the thermal printer 100. The value of the S-power indicates the total value of the electrical power applied to the maximum number of heat elements to be used for printing under the environment of the surrounding temperature of that S-temperature S-stand-by power value information record 60. In the environment of the surrounding temperature of that same S-temperature S-stand-by power value information record 60 and of the S-power value thereof, the S-temperature represents the temperature assumed to be reached by the thermal head 6 if the S-power value is applied to continue printing during the transporting of the sheet 1. In the environment of the surrounding temperature of that S-temperature S-stand-by power value information record 60 and of the S-power value thereof, the S-stand-by power value represents the electrical power value necessary for the purpose of raising a temperature of thermal head to S degrees by applying the same electrical power to all heat elements under the condition that the sheet 1 is not being transported. Various envisionable patterns of the surrounding temperature, the S-power value, and S-temperature S-stand-by power value are recorded into the S-temperature S-stand-by power value information table. The method of generating the S-temperature S-stand-by power value information table will be described later. Also, it is not necessary that data of all combinations of the surrounding temperature, the S-power value, and the S-temperature S-stand-by power value be recorded into the S-temperature S-stand-by power value information table, and, for example, data of a part of combinations thereof may be recorded therein. In this case, all combinations are of the various combinations of the above-noted patterns. If data of a part of the combinations is recorded therein, necessary data may be calculated by using a correction coefficient or interpolation.

Referring back to FIG. 4, the description of the controller 400 will be continued.

The acquirer 42 acquires various types of information, such as information of a surrounding temperature from the surrounding temperature measurement sensor. The acquirer 42 acquires the temperature of thermal head information from the temperature sensor, information of the S-power value based on the acquired temperature information, information of the S-power value based on the acquired S-power value, and information of the S-stand-by power value based on the acquired S-power value.

The feeder controller 43 controls the transporting of the sheet 1. Specifically the feeder controller 43 controls the transport roller R and the platen roller PR so as to transport the sheet 1.

The printing controller 44 controls the printing mechanism to print data to be printed to the sheet 1 and, in doing so, the printing controller 44 applies electrical power to heat elements not to be used for printing, in accordance with the number of heat elements not to be used in the printing among the plurality of heat elements of the platen roller PR, and the printing controller 44 applies to heat elements to be used for printing an electrical power that is higher than that applied to the heat elements not to be used in the printing.

Next, the method of creating the S-temperature S-stand-by power value information table will be described.

First, as the S-temperature and the S-stand-by power value, measured values of the temperature and the electrical power value that are reached by the thermal head 6 in an actual test of continuous printing under the condition at the time of calculating the S-power value may be used or, alternatively, values determined by a numerical simulation or by an experimental method may also be used. It is, however, desirable that, at the development stage before manufacturing and selling the thermal printer 100, the values are determined beforehand, assuming various conditions. The S-temperature and the S-stand-by power value obtained as noted above and other conditions (surrounding temperature and S-power value) are recorded, thereby creating the S-temperature S-stand-by power value information table. The S-temperature S-stand-by power value may be calculated from the S-power value, using the S-temperature S-stand-by power value information table generated beforehand by the above-mentioned method. When generating the S-temperature S-stand-by power value information table beforehand, if conditions other than transporting are satisfied, better accuracy can be expected, for example, by making the temperature be the same surrounding temperature as when the S-power value was determined, or by dealing not with the absolute temperature but rather with the difference of temperature from the surrounding temperature. Although the S-stand-by power value is normally a lower value than the S-power value, if there are changes of quality or color of the ink ribbon and thermal paper, or deterioration or damages of heat elements, the upper limit of the electrical power value shall be such that these do not occur.

The description regarding the method of creating the S-temperature S-stand-by power value information table have been completed.

Figure 7:
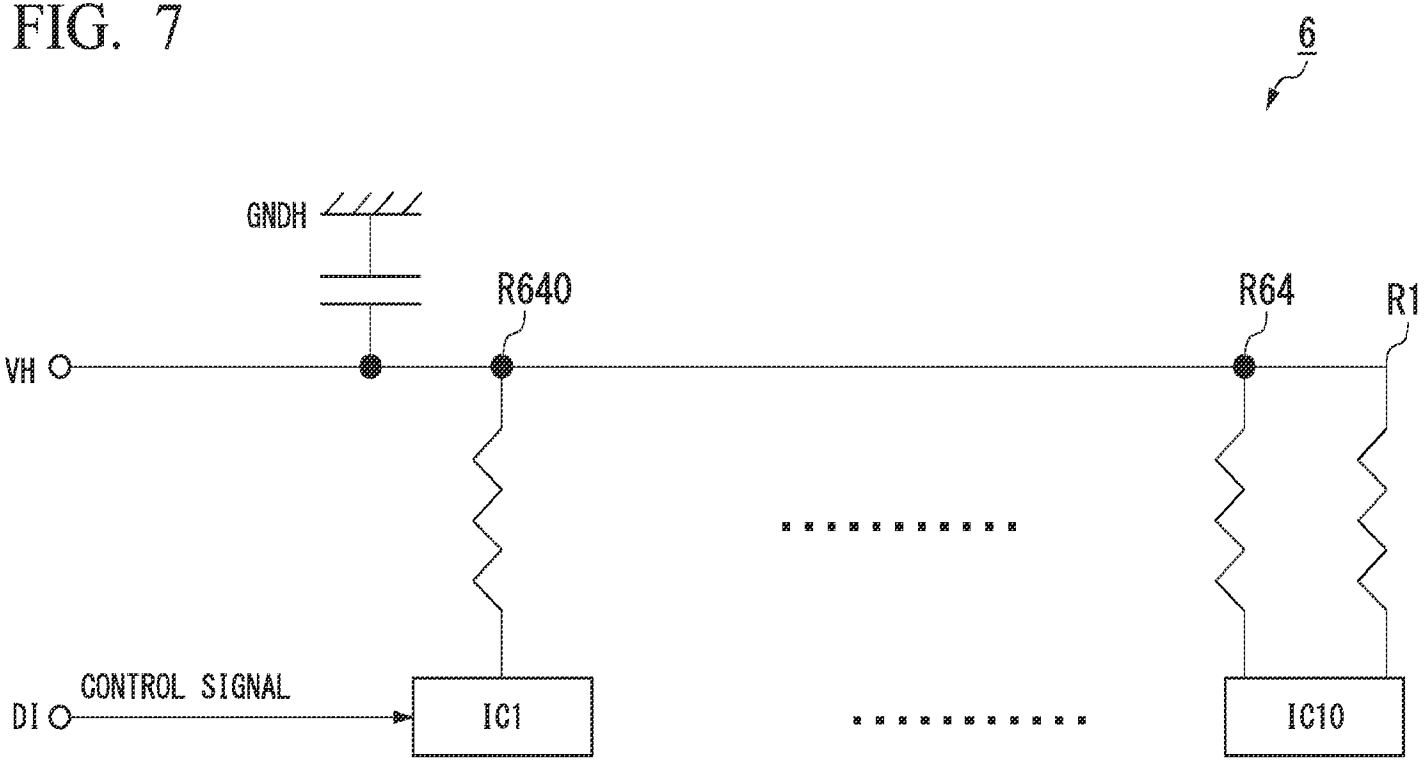
FIG. 7 is a schematic view of the inside of a thermal head.

FIG. 7 is a schematic view of the inside of a thermal head 6.

As shown in FIG. 7, the inside of the thermal head 6 has a plurality of heat elements, R1 to R640, and a plurality of ICs, IC1 to IC10. A plurality of heat elements are connected to each of ICs. For example, the heat elements R1 to R64 are connected to IC10. One terminal of each of heat elements is connected to the IC, and the other terminal is connected to the line segment representing VH. Electrical power represented by the total values of the electrical power applied to the heat elements R1 to R640 flows in the terminal of the VH, that electrical power being represented by the S-power value or the S-stand-by power value. A control signal is input to the terminal of the DI. The control signal includes information indicating an electrical power to be applied to each of the heat elements. A separate switch (not shown) connected to each heat element controls electrical power flowing thereto.

Figure 8:
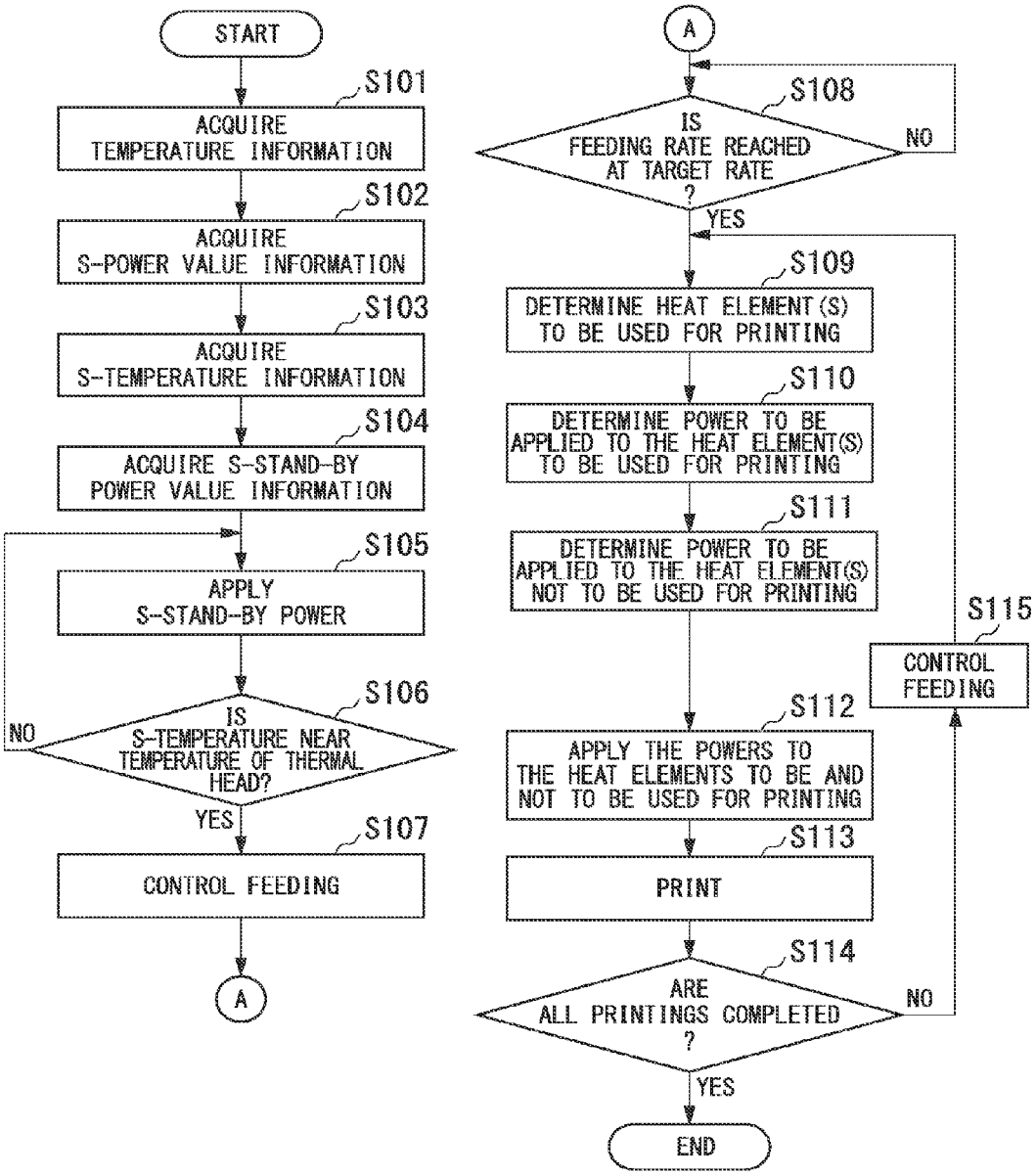
FIG. 8 is a flowchart showing the flow of processing in the thermal printer in the present embodiment.

FIG. 8 is a flowchart showing the flow of processing in the thermal printer 100 in the present embodiment. The processing shown in FIG. 8 is executed when an instruction to start printing is input.

The acquirer 42 acquires temperature information from the surrounding temperature measurement sensor and the temperature sensor (step S101). Specifically, the acquirer 42 acquires information of the surrounding temperature from the surrounding temperature measurement sensor, and information of the temperature of thermal head from the temperature sensor. The acquirer 42 references the S-power value information table to acquire the S-power value, based on the acquired temperature information (Step S102). The acquirer 42 reads the S-power value information table stored in the S-power value information storage 411. The acquirer 42 acquires the S-power value information record 50 corresponding to the acquired temperature of thermal head and the surrounding temperature from among the S-power value information records 50 of the read S-power value information table, and the acquirer 42 acquires the S-power value recorded in the S-power value item of the acquired S-power value information record 50.

The acquirer 42 references the S-temperature S-stand-by power value information table to acquire the S-temperature information and the S-stand-by power value information based on the acquired S-power value (Step S103 and Step S104). The acquirer 42 reads the S-temperature S-stand-by power value information table stored in the S-temperature S-stand-by power value information storage 412. The acquirer 42 acquires the S-temperature S-stand-by power value information record 60 corresponding to the acquired S-power value and the surrounding temperature from among the S-temperature S-stand-by power value information record 60 of the read S-temperature S-stand-by power value information table, and acquires the S-temperature information recorded in the S-temperature item, and the S-stand-by power value information recorded in the S-stand-by power value item of the acquired S-temperature S-stand-by power value information record 60.

The printing controller 44 applies the S-stand-by power indicated by the acquired stopping power value information to each of the heat elements (Step S105). The printing controller 44 applies to each of heat elements, an electrical power in which the S-stand-by power is apportioned by the total number of heat elements. This makes the electrical power applied to each of the heat elements same. The printing controller 44 determines whether or not the temperature of thermal head has reached the vicinity of the S-temperature (Step S106). This determination may be done based on the temperature of thermal head information acquired regularly by the acquirer 42 from the temperature sensor, or based on whether or not a preset amount of time has elapsed. If the temperature of thermal head does not reach the vicinity of the S-temperature (NO at step S106), the printing controller 44 executes processing of Step 105 and thereafter.

However, if the temperature of thermal head reaches to the vicinity of the S-temperature (YES at step S106), the printing controller 44 notifies the feeder controller 43 that the temperature of thermal head reached the vicinity of the S-temperature.

The feeder controller 43 rotates the transport roller R and the platen roller PR so as to transport the sheet 1 (step S107) and then the feeder controller 43 determines whether or not the feeding rate of the sheet 1 has reached the target rate (Step S108). This determination may be done by actually measuring the linear velocity of the sheet 1, by whether or not a preset given time has elapsed, or by measuring the platen roller PR rpm using encoder or the like.

If the feeding rate of the sheet 1 has not reached the target rate (NO at step S108), the feeder controller 43 waits until the feeding rate reaches the target rate.

However, if the rate has reached the target rate (YES at step S108), the feeder controller 43 notifies the printing controller 44 that the feeding rate reached to the target rate. When this notification is done from the feeder controller 43 the printing controller 44 determines heat elements to be used for printing based on the printing data (Step S109). The printing controller 44 determines an electrical power to be applied to the heat elements to be used for printing (Step S110). The electrical power to be applied to the heat elements to be used for printing is determined by apportioning the S-power value by the maximum number of heat elements to be used for the printing. For example, in a case that the S-power value is 500 and the maximum number of heat elements to be used in the printing is 50, the electrical power to be applied to each of the heat elements to be used for printing will be 10.

The printing controller 44 determines the electrical power to be applied to the heat elements not to be used for printing (step S111). The electrical power applied to the heat elements not to be used for printing is determined by apportioning the difference (first total electrical power) between the S-power that is indicated by the S-power value and the second total electrical power by the number of the heat elements not to be used in the printing. For example, the method of determining the electrical power to be applied to the heat elements not to be used for printing will be described for the case in which the number of heat elements provided with the thermal head 6 is 100, the S-power value is 500, the number of heat elements to be used for printing is 20, the number of heat elements not to be used for printing is 80, and the electrical power to be applied to the heat elements to be used for printing is 10.

First, the printing controller 44 calculates the second total electrical power. In this case, the second total electrical power will be 200. The printing controller 44 calculates the difference between the S-power value and the second total electrical power. In this case, the difference will be 300. The printing controller 44 determines the electrical power to be applied to each of the heat elements not to be used for printing by apportioning the calculated difference by the number of the heat elements not to be used in the printing. In this case, the electrical power to be applied to each of the heat elements not to be used for printing will be 3.75.

The printing controller 44 applies the electrical powers determined in the processing of step S110 and step S111 (step S112) to the heat elements to be used for printing and the heat elements not to be used for printing. Then, the printing controller 44 controls the printing mechanism so as to print the printing data onto the sheet 1 (step S113) and the printing controller 44 determines whether or not the entire printing is completed (step S114). For example, if the printing of the printing data has been completed, the printing controller 44 determines that all the printing has been completed.

However, if the printing of the printing data has not been completed, the printing controller 44 determines that all the printing has not been completed.

If all the printing has been completed (YES at step S114), the thermal printer 100 ends processing.

However, if all the printing has not been completed (NO at step S114), the feeder controller 43 rotates the transport roller R and the platen roller PR so as to transport the sheet 1 (step S115), after which the processing of the step S109 and thereafter is executed.

FIG. 9 is a drawing showing the result of comparing a method of related art with the method of present embodiment.

In describing FIG. 9, the premise will be that the total number of heat elements is 100, the S-power value is 500, and the electrical power that is to be applied per one of the heat elements to be used for printing is 100. The total number of heat elements is the number of all of the heat elements provided in the thermal head 6.

The example in FIG. 9 shows the result of comparing a method of related art with the method of present embodiment in the cases in which the number of heat elements to be used for printing is 0, 10, 20, 30, 40, and 50. The table using FIG. 9 will be specifically described below.

In the method of related art, if the number of heat elements to be used for printing is 0, the total value of the electrical power to be applied to all of the heat elements is 0. In this case, because the heat elements do not heat at all, the temperature of thermal head decreases. Also, in the method of related art, if the number of heat elements to be used for printing is 20, the total value of the electrical power to be applied to all the heat elements is 200. In this case, because the heat elements are heated, the temperature of thermal head increases. Also, in the method of related art, if the number of heat elements to be used for printing is 50, the total value of the electrical power to be applied to all the heat elements is 500. In this case, because the heat elements are heated the temperature of thermal head increases. By doing this, in the method of related art, the temperature of thermal head changes in accordance with the number of heat elements to be used for printing. That is, the temperature of thermal head changes in accordance with the printing data.

In contrast, in the method of the present embodiment, if the number of heat elements to be used for printing is 0, the total value of the electrical power to be applied to all the heat elements is 500. The total electrical power to be applied to the number of the heat elements to be used for printing (second total electrical power) is 10×0=0, and the total electrical power to be applied to the heat elements not to be used for printing (first total electrical power) is 500. In this case, the electrical power to be applied to each of the heat elements not to be used for printing is determined so that the total value of the electrical power applied to all the heat elements will be the S-power value (500 in the case of FIG. 8). In a case the number of heat elements to be used for printing is 0, the number of heat elements not to be used for printing is 100. That is, because the second total electrical power is 0, the first total electrical power will be 500. And then, dividing 500 by 100, the electrical power to be applied to each of the heat elements not to be used for printing will be 5. By doing this, the heat elements are heated by the electrical power value 500.

In the method of the present embodiment, if the number of heat elements to be used for printing is 20, the total value of the electrical power applied to all the heat elements is 500. The total electrical power to be applied to the number of the heat elements to be used for printing (second total electrical power) is 10×20=200, and the total electrical power to be applied to the heat elements not to be used for printing (first total electrical power) is 300. In this case, the electrical power to be applied to each of the heat elements not to be used for printing is determined so that the total value of the electrical power applied to all the heat elements will be the S-power value (500 in the case of FIG. 9). If the number of heat elements to be used for printing is 20, the number of heat elements not to be used for printing is 80. Because the second total electrical power is 10×20=200, the first total electrical power will become 300. And then, dividing 300 by 80, we obtain 3.75, which is the electrical power to be applied to each of the heat elements not to be used for printing. By doing this, the heat elements are heated by the total electrical power value of 500.

In the method of the present embodiment, if the number of heat elements to be used for printing is 50, the total value of the electrical power applied to all the heat elements is 500. The total electrical power to be applied to the number of the heat elements to be used for printing (second total electrical power) is 10×50=500, and the total electrical power to be applied to the heat elements not to be used for printing (first total electrical power) is 0. In this case, the electrical power to be applied to each of the heat elements not to be used for printing is determined so that the total value of the electrical power applied to the entire heat elements will be the S-power value (500 in the case of FIG. 9). If the number of heat elements to be used for printing is 50, the number of elements not to be used for printing is 0. Because the second total electrical power is 10×50=500, the first total electrical power will be 0. And then, dividing 50 by 0, the electrical power to be applied to each of the heat elements not to be used for printing will be 0. By doing this, the heat elements are heated by the total electrical power value of 500.

As described in the above, in the method of the present embodiment, even in the case in which the number of heat elements not to be used for printing is different than the cases noted above, heating is done in the same manner, so that the total electrical power value of all the heat elements will be the S-power value. The temperature of thermal head can be maintained as a constant value (S-temperature), regardless of the printing data.

According to the thermal printer 100 configured as described in the above, the loss of the quality for printing can be suppressed. These effects will be described in detail below.

The thermal printer 100 applies to the heat elements not to print an electrical power in accordance with the number of heat elements not to be used for printing from among a plurality of heat elements provided in the thermal head 6. This applies electrical power to the heat elements not to be used for printing. Furthermore, the electrical power is applied to the heat elements not to be printed in accordance with the number of the heat elements that are not to print. That is, the same electrical power is applied to each of the heat elements not to print. The thermal printer 100 can therefore increase the overall temperature of the thermal head 6 before printing, thereby enabling suppression of a loss of printing quality.

Also, the thermal printer 100 applies to each heat elements to print an electrical power that is higher than that applied to each of the heat elements not to print. By doing this, even if the thermal printer 100 applies electrical power with respect to all of the heat elements, the printing data can be printed by only heat elements that are to print.

Also, the thermal printer 100 determines the electrical power to be applied to the elements not to print, based on the difference between the S-power value and the total value of the electrical power applied to the heat elements to be used for printing and on the number of heat elements not to be used for printing. The thermal printer 100, for example, determines the electrical power to be applied to the heat elements not to be used for printing by apportioning the difference by the number of the heat elements that are not to print. Therefore, the total value of the electrical power applied to all the heat elements is constant, so that the temperature of thermal head can be maintained constantly, regardless of the number of heat elements that do not print.

A variation example of the thermal printer 100 will be described below

In the present embodiment, although the example of the label roll sheet 1 has been described, the thermal printer 100 can also be applied to cut paper.

In the present embodiment, although the configuration in which electrical power is applied to all the heat elements provided in the thermal head 6, application of electrical power is not necessarily limited in this manner. For example, the configuration may be such that the thermal printer 100 applies electrical power to the heat elements remaining after eliminating, from among all of the heat elements of the thermal head 6, the heat elements that are not used for printing.

The application of electrical power in the above descriptions may be performed by method of direct application, by pulse application, or by alternating-current application. However, plus application method is generally adopted, in which the pulse width is adjusted with a constant voltage value, thereby adjusting the electrical power. This is because it is easier to adjust plus width than to adjust the voltage value.

Regarding the S-power value, if maximum number of heat elements to be used for printing at the same time is large and also this number accounts for a large proportion (for example, 80%) of the total number of heat elements provided in the thermal head 6, the S-power value becomes excessively large. Because such a situation is anticipated, a threshold of the S-power may be set. Under the pre-conditions of the description of FIG. 9, for example, consider the case in which the S-power value is 1000. If there is a printing pattern in which all the heat elements print at the same time, for example, a pattern of horizontal line that is the full span in the width direction along the thermal head 6, the S-power value will be 1000. In this case, if there is a printing data having 0 heat elements to be used for printing, it is necessary that an electrical power value of 10 be added to the heat elements not to be used for printing. Because this is equal to the electrical power value 10 applied to each heat element to be used for printing, it can be imagined that printed will result even in the case of heat elements not to be used for printing. That is, the more the S-power value approaches an anticipatable maximum value 100, the smaller is the difference of the electrical power value between the heat elements to be used for printing and the heat elements not to be used for printing, making the margin excessively small. Given this, in order to prevent such a case, the S-power value is made small by providing a threshold of the S-power value. By doing this, in the local printing pattern at an electrical power exceeding the S-power value, the margin is made large, so as to permit a short-term increase of temperature of the thermal head 6, thereby enabling adverse effect on the printing quality to be made as small as possible.

The thermal printer 100 may be configured so that, if the surrounding temperature varies greatly during printing, the S-power value is changed during printing. For example, in a case that the room temperature changes greatly during continuous printing over a long period of time, the surrounding temperature can be affected and change. In such cases, the temperature of thermal head may be affected, and the printing quality may be adversely affected. In such cases, the thermal printer 100 temporarily changes the S-power value, based on the surrounding temperature, so that the temperature of thermal head is temporarily constant. For example, the acquirer 42 acquires information of the S-power value based on the surrounding temperature from the S-power value information table. The printing controller 44 then changes the S-power value from the acquired information to the newly acquired S-power value.

In the processing of the step S106 in FIG. 8, application can be done over a period of time that is neither shorter than nor longer than the time for the temperature of thermal head to reach the vicinity of the S-temperature, this being appropriate in view of, for example, conserving time and electrical power up until the start of printing. After the power supply to the thermal printer 100 is turned on, however, the thermal printer 100 may always apply electrical power without any relationship to the start of printing, or may apply electrical power over a shorter period of time than the time until reaching the vicinity of the S-temperature if the effect on the printing quality is within an allowable range. In the thermal printer 100, assuming the conditions of two stages, one being idling and the other being a condition in which instantaneous printing is possible, a switched electrical power value may be applied to the heat elements according to these stages, an electrical power less than the S-stand-by power value being applied to the heat elements when idling, and an the S-stand-by power value being applied to the heat elements when in the condition in which printing is instantaneously possible, so as to both reduce the electrical power consumption a shorten the time until the start of printing.

The printing head 6-1 may be configured to have a means of heating or a means of cooling the temperature of thermal head, or a means of heating or a means of cooling the surrounding temperature.

Also, the thermal printer 100 may be configured such that, if printing by the same heat elements to be used for printing continues and the heat elements near the heat elements to be used for printing are simultaneously printing, so called the historical compensation is performed, adjusting the pulse length or voltage value, so that the temperature of heat elements does not increase excessively.

The thermal printer 100 may be configured so as to apply to the heat elements an electrical power corrected based on the temperature of thermal head. For example, the thermal printer 100 may apply to the heat elements not to be used for printing an electrical power that is applied to heat elements not to be used for printing and that is corrected based on the temperature of thermal head. Furthermore, the thermal printer 100 applies the electrical power that is applied to heat elements to be used and that is corrected based on the temperature of thermal head to the heat elements to be used and performs processing to apply to the heat elements the electrical power corrected based on the temperature of thermal head, during printing or during or during transporting of the sheet without printing. The processing to apply to the heat elements an electrical power corrected based on the temperature of thermal head will be described specifically below.

If the temperature of thermal head is excessively high, for example, because of continuous printing, the temperature of the heat elements also increases. For this reason, if the temperature of thermal head is excessively high, the printing controller 44 corrects the electrical power applied to each of the heat elements to be used for printing that has been determined in the processing of step S110 in FIG. 8. For example, the printing controller 44 determines as the electrical power to be applied to each heat element to be used for printing an electrical power that is lower than that which is to be applied to each heat element to be used for printing, which has been determined by the processing of the step S110 in FIG. 8. Then, the printing controller 44 determines the electrical power to be applied to the heat elements not to be used for printing. The electrical power to be applied to the heat elements not to be used for printing, as described in the above, is determined by apportioning the difference (first total electrical power) between the S-power that is indicated by the S-power value and the second total electrical power by the number of the heat elements not to be used for the printing. By doing this, the printing controller 44 applies to the heat elements an electrical power that is corrected based on the temperature of thermal head. If the temperature of thermal head is excessively high, the electrical power applied to each heat element to be used for printing may be set beforehand by a table.

This completes the descriptions of processing for applying to the heat elements an electrical power corrected based on the temperature of thermal head during the time period of printing.

The processing for applying to the heat elements an electrical power corrected based on the temperature of thermal head during a time period when transporting of the sheet is stopped and printing is not done, is performed as follows.

If the temperature of thermal head is excessively high, for example, because of continuous printing, the temperature of the heat elements also increases. For this reason, if the temperature of thermal head is excessively high, the printing controller 44 corrects the S-stand-by power applied to all the heat elements by the processing of step S105 in FIG. 8. For example, the printing controller 44 determines as the S-stand-by power applied to all the heat elements an electrical power that is a lower electrical power than that to be applied to all the heat elements by the processing of the step S105 in FIG. 8. By doing this, the printing controller 44 applies to the heat elements an electrical power corrected based on the temperature of thermal head. If the temperature of thermal head is excessively high, the S-stand-by power applied to all the heat elements may be set beforehand by a table.

This ends the description of processing for applying to the heat elements an electrical power that is corrected based on the temperature of thermal head during a time period of stopping to transporting of the sheet without printing being done.

The thermal printer 100 may be configured to apply to the heat elements an electrical power that is corrected by the surrounding temperature. The description regarding this processing will be omitted because the same processing is performed as the processing to apply to the heat elements an electrical power corrected based on the temperature of thermal head.

The thermal printer 100 may be configured to provide a setting unit to set a temperature (for example, surrounding temperature) input by a user. In the case of such a configuration, the thermal printer 100 applies to heat elements an electrical power that is corrected based on temperature set by a setting unit. The thermal printer 100 performs processing to apply to heat elements an electrical power corrected based on the temperature set by the setting unit, either during printing, or when the transporting is stopped and printing is not being done. The description of an actual processing will be omitted because processing is the same as that for applying to heat elements an electrical power that is corrected based on the above-noted temperature of thermal head or the surrounding temperature.

According to at least one embodiment described above, having a plurality of heat elements that are heated by applying electrical power, a printing controller 44 that applies an electrical power to heat elements not to be used for printing in accordance with the number of heat elements not to be used in the printing from among the plurality of heat elements, and a thermal head that prints using the plurality of heat elements suppresses a loss of printing quality.

A part of the functionality of the thermal printer 100 in the above-described embodiment may be implemented by a computer. In this case, a program for implementing the functions may be recorded into a computer-readable storage medium and the program recorded in the storage medium may read into a computer system, which executes the program so as to achieve implementation of the functions. The term "computer system" used here shall include an operating system and hardware such as peripheral devices. The term "computer-readable storage medium" refers to a removable medium or a storage device. The removable medium means a flexible disk, an optomagnetic disk, a ROM, and a CD-ROM or the like. The storage device means a hard disk or the like built into a computer system. Additionally, the term "computer-readable storage medium" encompasses one that dynamically holds a program for a short period of time, such as a communication line when a program is transmitted via a communication circuit. The communication circuit is network such as the Internet or a telephone circuit. Additionally, the "computer-readable storage medium" may a volatile memory within a computer system serving as a server or client. The volatile memory holds a program for a given period of time. The above-noted program may also be one for implementing a part of the above-noted functionalities, and further may be one enabling implementation by combination with a program that already has recorded therein the above-noted functionality in a computer system.

While certain embodiments have been described, these embodiments have been presented by way of example only, and are not intended to limit the scope of the inventions. Indeed, the novel embodiments described herein may be embodied in a variety of other forms, and various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A thermal printer comprising:

a plurality of heat elements for printing; and a printing controller configured to apply a first electrical power level to at least a first heat element of the plurality of heat elements, the first heat element to be in non-use in a printing, the first electrical power level being lower than a second electrical power level applied to at least a second heat element of the plurality of heat elements in the printing, the second heat element to be in use in the printing, wherein the printing controller is further configured to calculate the first electrical power level by dividing a remainder power number by a total number of heat elements of the plurality of heat elements to be in non-use in the printing, the remainder power number being obtained by subtracting a total amount of power to be applied to the heat elements of the plurality of heat elements to be in use in the printing from a fixed total amount of power to be applied to the plurality of heating elements for printing.

2. A thermal printer comprising:

a plurality of heat elements for printing; and a printing controller configured to apply a fixed total amount of power to the plurality of heat elements during a printing, wherein the printing controller is configured to apply a first level of power to each heat element of the plurality of heat elements that is to be in use during the printing and apply a second level of power to each heat element of the plurality of heat elements that is to be in non-use in the printing, wherein the second level of power is lower than the first level of power, wherein the printing controller is configured to calculate the second level of power by dividing a remainder power value by a total number of heat elements of the plurality of heat elements that is to be in non-use in the printing, the remainder power value being obtained by subtracting a total of amount of power to be applied to the heat elements of the plurality of heat elements that are to be in use in the printing from the fixed total amount of power.

* * * * *